US008703664B2

(12) United States Patent
Hosoda et al.

(10) Patent No.: US 8,703,664 B2
(45) Date of Patent: Apr. 22, 2014

(54) METAL ROLLING OIL COMPOSITION

(75) Inventors: Kouji Hosoda, Kanagawa (JP); Keiji Izawa, Kanagawa (JP); Hitoshi Hasegawa, Kanagawa (JP)

(73) Assignee: Yushiro Chemical Industry Co., Ltd., Tokyo (JP)

( * ) Notice: Subject to any disclaimer, the term of this patent is extended or adjusted under 35 U.S.C. 154(b) by 0 days.

(21) Appl. No.: 13/376,506

(22) PCT Filed: Feb. 12, 2010

(86) PCT No.: PCT/JP2010/052096

§ 371 (c)(1), (2), (4) Date: Dec. 6, 2011

(87) PCT Pub. No.: WO2010/146889

PCT Pub. Date: Dec. 23, 2010

(65) Prior Publication Data

US 2012/0101016 A1 Apr. 26, 2012

(30) Foreign Application Priority Data

Jun. 16, 2009 (JP) ..... 2009-143563

(51) Int. Cl.

| | |
|---|---|
| ***C10M 169/04*** | (2006.01) |
| ***C10M 173/00*** | (2006.01) |
| ***C07C 309/62*** | (2006.01) |
| ***C10M 159/24*** | (2006.01) |

(52) U.S. Cl.

USPC ..... 508/110; 508/115; 508/306; 508/308; 508/390; 508/397

(58) Field of Classification Search

USPC ..... 508/306, 308, 110, 115, 390, 397

See application file for complete search history.

(56) References Cited

U.S. PATENT DOCUMENTS

| | | | | |
|---|---|---|---|---|
| 6,617,288 | B1 * | 9/2003 | Mathur et al. | 508/431 |
| 2003/0220205 | A1 | 11/2003 | Manka et al. | |
| 2004/0214734 | A1 | 10/2004 | King et al. | |
| 2009/0036338 | A1 * | 2/2009 | Hee et al. | 508/506 |

FOREIGN PATENT DOCUMENTS

| | | | |
|---|---|---|---|
| EP | 0 399 377 | A1 | 11/1990 |
| JP | 42-19705 | B1 | 10/1967 |
| JP | 52-65748 | A | 5/1977 |
| JP | 08-325588 | A | 12/1996 |
| JP | 10-298580 | A | 11/1998 |
| JP | 11-080768 | A | 3/1999 |
| JP | 2008-007544 | A | 1/2008 |
| JP | 2008-189876 | A | 8/2008 |
| JP | 2009-155432 | A | 7/2009 |

OTHER PUBLICATIONS

International Search Report: mailed Apr. 13, 2010; PCT/JP2010/052096.

European Search Report; dated Nov. 20, 2012; Application No. 10789267.1-2104 / 2444476 PCT/JP2010052096.

* cited by examiner

*Primary Examiner* — Prem Singh
*Assistant Examiner* — Vishal Vasisth
(74) *Attorney, Agent, or Firm* — Ladas & Parry LLP

(57) ABSTRACT

The present invention provides a metal rolling oil composition excellent in both an emulsion stability and a plating-out property, wherein the metal rolling oil composition comprises: at least one base oil selected from the group consisting of a mineral oil, animal and vegetable fat and oil, and synthetic ester; a surfactant; and an elastomer.

9 Claims, No Drawings

METAL ROLLING OIL COMPOSITION

TECHNICAL FIELD

The present invention relates to a metal rolling oil composition used in cold rolling of metal.

BACKGROUND ART

A conventionally used cold rolling oil includes a substance such as a mineral oil, animal and vegetable fat and oil, and synthetic ester, or a mixture thereof, as a base oil, into which an oiliness improving agent such as a fatty acid; an extreme-pressure additive such as a phosphoric ester; an anti-rust additive; an antioxidant; an emulsifier, and the like are blended. Usually, this cold rolling oil is emulsified and dispersed in water to be used as an emulsive dispersion having a concentration of approximately from 1 to 10% by volume.

This emulsive dispersion is generally called a coolant; and is usually used in a circulation method, by which the emulsive dispersion is sprayed at a work roll and a steel sheet from a nozzle by way of a pump from a tank, and returned to the tank. The cold rolling oil used in this circulation method exerts a lubricating effect by function of being spread and deposited over the work roll and the surface of the steel sheet (the function being called a plating-out property).

In recent years, with the advance in rolling technologies, high rolling speed and mass production have been attempted; and it is desired to further improve a lubricity, and an emulsion stability at a time of circulation, of a metal rolling oil. Patent Documents 1 to 3 disclose metal rolling oil compositions which exhibit excellent emulsion stabilities and plating-out properties.

Patent Document 1: Japanese Patent Application Laid-Open (JP-A) No. 08-325588

Patent Document 2: JP-A No. 10-298580

Patent Document 3: JP-A No. 2008-007544

DISCLOSURE OF INVENTION

Problems to be Solved by the Invention

However, even though the emulsion stabilities of the metal rolling oil compositions disclosed in Patent Documents 1 to 3 have been improved, their plating-out properties are hardly sufficient compared to conventional rolling oil compositions.

A cold rolling oil into which a nonionic surfactant, an anionic surfactant, or the like is blended for emulsification and dispersion, changes its plating-out property when the type of the surfactant or the amount of the surfactant blended are adjusted. For example, if an emulsion stability of a coolant is increased by adjusting an HLB value of a nonionic surfactant or the amount of surfactant blended, its plating-out property is degraded, leading to insufficient lubrication. Further, if the HLB value of the nonionic surfactant or the amount of surfactant blended is adjusted to enlarge a particle size of the coolant for improving its plating-out property, the emulsified state of the coolant becomes unstable, causing various troubles while the coolant is circulated.

That is, adjusting a surfactant to be applied in this way causes an emulsion stability and a plating-out property of a coolant to be in a relation of tradeoff; thus a coolant which maintains both an emulsion stability and a plating-out property has been desired. An object of the present invention is to provide a metal rolling oil composition which is excellent in both an emulsion stability and a plating-out property.

Means for Solving the Problems

A first aspect of the present invention is a metal rolling oil composition comprising: at least one base oil selected from the group consisting of a mineral oil, animal and vegetable fat and oil, and synthetic ester; a surfactant; and an elastomer.

In the first aspect of the present invention, for 100 parts by mass of the base oil, the surfactant in an amount of 0.1 parts by mass or more and 10 parts by mass or less, and the elastomer in an amount of 0.05 parts by mass or more and 20 parts by mass or less are preferably contained.

In the first aspect of the present invention, it is preferable to further comprise an oiliness agent.

In the first aspect of the present invention, it is preferable to still further comprise an antioxidant.

A second aspect of the present invention is a coolant which is prepared by dispersing, in water, the metal rolling oil composition according to the first aspect of the present invention.

Effects of the Invention

According to the metal rolling oil composition and the coolant containing the metal rolling oil composition, of the present invention, both the emulsion stability and the plating-out property can be excellent.

MODES FOR CARRYING OUT THE INVENTION

A metal rolling oil composition of the present invention comprises: a base oil; a surfactant; and an elastomer.

(Base Oil)

As a base oil to be used for the present invention, any oils that have been conventionally used for this kind of metal rolling oil composition may be used. Specifically, examples include mineral oils such as a spindle oil, machine oil, turbine oil, and cylinder oil; include animal and vegetable fats and oils such as a whale oil, tallow, lard, rapeseed oil, castor oil, bran oil, palm oil, and coconut oil; and include synthetic esters which are a monoester of a fatty acid obtained from tallow, castor oil, coconut oil or the like as well as a synthetic fatty acid, and an aliphatic monohydric alcohol containing 1 to 22 carbon atoms; and which are di-, tri-, and tetra-esters of the above described fatty acids as well as synthetic fatty acids, and polyhydric alcohols such as ethylene glycol, neopentylglycol, trimethylolpropan, and pentaerythritol. These mineral oils, animal and vegetable fats and oils, and synthetic esters, as a base oil, may be used in combination.

(Surfactant)

As a surfactant, an anionic surfactant, cationic surfactant, and nonionic surfactant may be used. Examples of the anionic surfactant include: alkane sulfonate sodium salt; sodium naphthenate soap; and alkylbenzene sulfonate sodium salt. Examples of the cationic surfactant include: alkyltrimethylammonium salt; dialkyl dimethyl ammonium chloride; and alkylpyridinium chloride. Examples of the nonionic surfactant include: a propyleneglycol-ethyleneglycol copolymer; and a monoester or polyester prepared from at least one of a higher fatty acid, poly-fatty acid, and polycondensed hydroxy fatty acid, and at least one polyhydric alcohol such as polyethyleneglycol, glycerin, and sorbitol. A binding form of the propyleneglycol-ethyleneglycol copolymer is not particularly limited; it may be a block polymerization or a random polymerization, for example. Further, modified polyalkene may be copolymerized; and examples of the modified polyalkene include maleinized polybutene. Examples of the higher fatty acid include C12-C18 saturated fatty acids or C12-C18 unsaturated mono fatty acids, such as lauric acid, myristic acid, palmitic acid, stearic acid, and oleic acid. Examples of the poly-fatty acid include: a C36 dimer acid of oleic acid or linoleic acid; and a C54 trimer acid of oleic acid or linoleic acid. As for the polycondensed hydroxy fatty acid, the polycondensed hydroxy fatty acid having the carbon number of approximately from 36 to 180 is suitable, and for example with 2 to 10 molecules of hydroxystearic acid bonded. As for the polyethylene glycol, the polyethylene glycol having a molecular weight of approximately from 1,500 to 2,500 is preferable. As for the polyester, a diester, and if possible, tri-, and tetra-esters, etc. are employed.

A molecular weight of a surfactant needs to be from 2,000 to 15,000. If the molecular weight is less than 2,000, anti-coalescence of oil particles is inhibited; and according to the data obtained by the inventors, if the molecular weight exceeds 15,000, an oil solubility is deteriorated. Further, an HLB value of these surfactants needs to be from 5 to 9. If the value is less than 5, the oil solubility becomes strong; and if the value exceeds 9, a water solubility becomes strong. Therefore, in either case, the surfactants are unable to stably exist at the interface between the oil particles and the water.

For 100 parts by mass of the base oil, the lower limit of the amount of the surfactant blended is preferably 0.1 parts by mass or more, more preferably 1 parts by mass or more, even more preferably 2 parts by mass or more, and in especial preferably 4 parts by mass or more. Further, in the present invention, even if the surfactant in an amount of 5 parts by mass or more is added, the plating-out property can be satisfactory. Conventionally, when the amount such as this, of surfactant is added, the emulsion stability becomes satisfactory, but the plating-out property is degraded. However, in the present invention, it is possible to maintain both the emulsion stability and the plating-out property. If the amount of surfactant added is excessively small, a stability of emulsification and dispersion is likely to be deteriorated. In addition, the upper limit is not particularly limited; however, in view that the effect of adding a surfactant gets saturated, the upper limit is preferably 10 parts by mass or less, more preferably 7 parts by mass or less, and even more preferably 6 parts by mass or less.

(Elastomer)

The metal rolling oil composition of the present invention comprises an elastomer. Because of this, the metal rolling oil composition of the present invention is capable of improving the emulsion stability, and also of improving the plating-out property. Thus, in the present invention, the emulsion stability and the plating-out property, which have been in a relation of tradeoff heretofore, can both be improved by comprising the elastomer.

A rolling oil is emulsified and dispersed in water to be used as a coolant. The coolant sprayed from a nozzle strikes against a steel sheet. At this time, the emulsified state of the coolant is destroyed, and only the oil fraction is spread and deposited over the metal surface. It is seen that the coolant is continuously supplied, and deposition of the oil fraction and re-washing are repeated, thereby forming a plate-out oil film. Herein, the elastomer is insoluble in water, and thus exists in the oil phase, preventing the re-washing at a time of forming the plate-out oil film by the effect of inhibiting fluidity enabled by the level of its molecular weight and/or its cross-linked intramolecular bonding structure. Thus, the plating-out property is seen to improve by comprising the elastomer.

The elastomer used in the present invention is not particularly limited as long as it is dissolved in the base oil and is a rubber-like elastic body; however, breaking it into the two major groups, a thermosetting elastomer and a thermoplastic elastomer may be used. Examples of the thermosetting elastomer include natural rubber, urethane rubber, silicone rubber, and fluoro rubber. In addition, the thermoplastic elastomer has a microphase-separated structure with a soft phase and a hard phase, and examples thereof include a styrene-butadiene block copolymer, an isoprene-isobuthylene copolymer, an ethylene-propylene copolymer, and polyisobutylene.

The lower limit of a molecular weight of the elastomer is preferably a weight average of 30,000 or more, and more preferably a weight average of 50,000 or more. The upper limit is preferably a weight average of 6,000,000 or less, and more preferably a weight average of 2,500,000 or less. If the molecular weight is too small, the effect for preventing re-washing of the plate-out oil film is likely to be reduced. Moreover, if the molecular weight is too large, the solubility (of the elastomer) in the base oil is likely to be deteriorated.

For 100 parts by mass of the base oil, the lower limit of the content of the elastomer is preferably 0.05 parts by mass or more, more preferably 0.1 parts by mass or more, and even more preferably 0.2 parts by mass or more. The upper limit is preferably 20 parts by mass or less, more preferably 10 parts by mass or less, even more preferably 5 parts by mass or less, even further more preferably 3 parts by mass or less, and in especial preferably 2 parts by mass or less. If the content of the elastomer is too small, the effect for improving the plating-out property is reduced; conversely, if the content of the elastomer is too large, the effect gets saturated.

(Additives)

Other than the above described components, a variety of known additives, such as an oiliness agent, extreme-pressure agent, and antioxidant may be added to the metal rolling oil composition of the present invention. Examples of the oiliness agent include fatty acids such as stearic acid, oleic acid, linoleic acid, linolenic acid, arachic acid, behenic acid, erucic acid, trimellitic acid, palm oil fatty acids, tallow fatty acids, lard fatty acids, soybean oil fatty acids, rapeseed oil fatty acids, and tall oil fatty acids; include esterified fatty acids of the above fatty acids; and include dibasic acids such as a dimer acid. Examples of the extreme-pressure agent include phosphoric esters such as trialkyl phosphate, dialkyl phosphate, and triaryl phosphate; include phosphite esters such as trialkyl phosphite, dialkyl phosphite, and triaryl phosphite. Examples of the antioxidant include phenolic compounds such as di-t-butyl-p-cresol; and include aromatic amines such as phenyl-α-naphthylamine.

<Coolant>

The metal rolling oil composition of the present invention is mixed with water, and the mixed solution is dispersed with a mixer or the like, resulting in a coolant in which the metal rolling oil composition is emulsified and dispersed in the water. The proportion of the metal rolling oil composition in the coolant is normally 1 to 10% by volume. The lower limit of the average particle size of the oil component in the coolant is preferably 3 μm or more, more preferably 4 μm or more, and even more preferably 5 μm or more. The upper limit is preferably 11 μm or less, more preferably 10 μm or less, even more preferably 9 μm or less, and in especial preferably 8 μm or less. If the average particle size is too small, the plating-out property is likely to be degraded; conversely, if the average particle size is too large, the emulsion stability is likely to be degraded. The average particle size of the oil component in the coolant is measured by a coulter counter.

The usage of the coolant is the same as the conventional one: the coolant is sprayed at a rolling roll or a material to be rolled while it is circulated.

EXAMPLES

Examples 1 to 9 and Comparative Examples 1 to 7

A predetermined amount of each of the components shown in Table 1 is blended to prepare a metal rolling oil composition of Examples 1 to 9. Likewise, a predetermined amount of each of the components shown in Table 2 is blended to prepare a metal rolling oil composition of Comparative Examples 1 to 7.

<Preparation of Coolant>

Each of the metal rolling oil compositions was added to water so as to have 2% by volume; was subjected to a pump circulation and stirred for 30 minutes by using a gear pump (at a flow rate of 30 L/min) and a homomixer (at 3,000 rpm); and thereby an emulsive dispersion (Amount of liquid: 10 L; Temperature of liquid: 55° C.) was prepared. The average particle size of the metal rolling oil composition in this dispersion was measured by a coulter counter (Multisizer II). Then, 200 mL of this dispersion was taken and allowed to stand for 30 minutes, after which a concentration of 100 mL of a sample oil in a lower layer was measured to evaluate an emulsion stability (ESI-30) of the coolant. The calculation method of the ESI-30 is shown below.

(Calculation Method of ESI-30)

ESI-30(%)=[(Concentration of 100 mL of a sample oil in a lower layer after being allowed to stand for 30 minutes)/(Initial concentration)]×100

(Evaluation of Plating-Out Property)

The above obtained emulsive dispersion was circulated for one hour with a pump; this emulsive dispersion was sprayed at a vertically-hung test piece for two seconds; and the amount ($g/m^2$) of oil deposited at this moment was measured.

Test piece: SPCC-SD, 1.2×60×80 mm

Temperature of test piece: 120° C.

Spray flow rate: 2.1 L/min

Concentration of sample oil: 2% by volume

Amount of liquid: 10 L

Temperature of liquid: 55° C.

TABLE 1

| | | Examples | | | | | | | | |
|---|---|---|---|---|---|---|---|---|---|---|
| | | 1 | 2 | 3 | 4 | 5 | 6 | 7 | 8 | 9 |
| Base oil | Tallow | | | | | | | | | |
| | Palm oil | 40 | 40 | 40 | 40 | 40 | 40 | | 40 | |
| | Synthetic ester | 50.4 | 50.3 | 50 | 49.5 | 56.9 | 57.4 | 97.4 | 56.9 | 97.4 |
| Surfactant | A | 3 | 3 | 3 | 3 | 1 | 1 | 0.7 | 1 | 0.7 |
| | B | 1.5 | 1.5 | 1.5 | 1.5 | 0.5 | 0.2 | | 0.5 | |
| | C | | | | | 0.5 | 0.3 | 0.8 | 0.5 | 0.8 |
| Oiliness agent A | | | | | | | | | | |
| Oiliness agent B | | 4 | 4 | 4 | 4 | | | | | |
| Antioxidant | | 1 | 1 | 1 | 1 | 1 | 1 | 1 | 1 | 1 |
| Elastomer A | | 0.1 | 0.2 | 0.5 | 1 | 0.1 | 0.1 | 0.1 | | |
| Elastomer B | | | | | | | | | 0.1 | 0.1 |
| Amount of plateout [$g/m^2$] | | 0.58 | 0.64 | 0.7 | 0.7 | 0.84 | 0.86 | 0.88 | 0.85 | 0.86 |
| Average particle size [μm] | | 6 | 6 | 6 | 6 | 5 | 6 | 7 | 5 | 7 |
| ESI-30 | | 95 | 95 | 95 | 95 | 97 | 95 | 93 | 97 | 93 |

Synthetic ester: trade name "UNISTER-H-381R", NOF Corporation.

Surfactant A: trade name "IONET S-80", Sanyo Chemical Industries, Ltd., a sorbitan fatty acid ester surfactant.

Surfactant B: trade name "IONET DO-1000", Sanyo Chemical Industries, Ltd., a polyoxyethylene fatty acid diester.

Surfactant C: trade name "Hypermer A60", Croda Japan, a copolymer of maleinized polybutene, polyalkylene glycol, and glycerin.

Oiliness agent A: trade name "TOENOL #1050", TOEI CHEMICAL CO., LTD., a tallow fatty acid.

Oiliness agent B: trade name "NAA-35", NOF Corporation, oleic acid.

Antioxidant: trade name "Sumilizer BHT", SUMITOMO CHEMICAL.

Elastomer A: natural rubber (mainly composed of cis-1,4-polyisoprene, weight-average molecular weight: 100,000 to 2,500,000).

Elastomer B: isobutylene rubber (poly(1,1-dimethylethylene, weight-average molecular weight: 60,000 to 5,000,000).

TABLE 2

| | | Comparative Examples | | | | | | |
|---|---|---|---|---|---|---|---|---|
| | | 1 | 2 | 3 | 4 | 5 | 6 | 7 |
| Base oil | Tallow | 50 | | | | | | |
| | Palm oil | 45 | 40 | 40 | 40 | | | |
| | Synthetic ester | | 50.5 | 57 | 57.5 | 97.5 | 97.4 | 96.5 |
| Surfactant | A | 0.5 | 3 | 1 | 1 | 0.7 | 0.7 | 0.7 |
| | B | 0.5 | 1.5 | 0.5 | 0.2 | | | |
| | C | | | 0.5 | 0.3 | 0.8 | 0.8 | 0.8 |
| Oiliness agent A | | 3 | | | | | | |
| Oiliness agent B | | | 4 | | | | | |
| Higher-molecular polymer | | | | | | | 0.1 | 2 |
| Antioxidant | | 1 | 1 | 1 | 1 | 1 | 1 | 1 |
| Amount of plateout [$g/m^2$] | | 0.5 | 0.35 | 0.5 | 0.53 | 0.54 | 0.58 | 0.67 |
| Average particle size [μm] | | 12 | 6 | 5 | 6 | 7 | 7 | 8 |
| ESI-30 [%] | | 70 | 95 | 97 | 95 | 93 | 93 | 93 |

Higher-molecular polymer: trade name "ACLUBE 702", Sanyo Chemical Industries, Ltd., a mineral oil solution of alkyl methacrylate-based copolymer.

From the results of the above Tables 1 and 2, it was found that the particle size of the coolant which uses the metal rolling oil composition of the present invention was small and that both the emulsion stability and the plating-out property were satisfactory. Adding a higher-molecular polymer enabled maintenance of both the emulsion stability and the plating-out property; however, the effect for improving the plating-out property was smaller compared to the effect in the case of adding the elastomer, and the plating-out property was hardly excellent (Comparative Examples 6 and 7).

In both cases of adding the elastomer and of adding the higher-molecular polymer, if the amount of addition thereof is increased, the viscosity of the coolant is increased. If the viscosity is increased, contaminants around a rolling mill are likely to be retained, resulting in deposition of the contaminants.

If the deposited substances drop on a rolled steel sheet, the quality of the rolled steel sheet is degraded. Thus, it becomes necessary to remove the deposited substances, which causes increase in the load in the subsequent step. Further, the deposited substances cause deterioration of a work environment as well as risks for fires. Since an elastomer exerts excellent effects for improving the plating-out property with a smaller amount, compared to a higher-molecular polymer, problems of the deposited substances such as this do not occur.

The invention has been described above as to the embodiment which is supposed to be practical as well as preferable at present. However, it should be understood that the invention is not limited to the embodiment disclosed in the specification and can be appropriately modified within the range that does not depart from the gist or spirit of the invention, which can be read from the appended claims and the overall specification, and a metal rolling oil composition and a coolant with such modifications are also encompassed within the technical range of the invention.

Industrial Applicability

A metal rolling oil composition of the present invention is used in cold rolling of metal.

The invention claimed is:

1. A coolant which is prepared by dispersing, in water, a metal rolling oil composition, wherein proportion of the metal rolling oil composition in the coolant is 1 to 10% by volume, the average particle size of the oil component in the coolant is between 3 μm and 11 μm inclusive, the metal rolling oil composition comprises: at least one base oil selected from the group consisting of a mineral oil, animal and vegetable fat and oil, and synthetic ester; a surfactant of which a molecular weight is from 2,000 to 15,000 and of which HLB is from 5 to 9; and an elastomer of which a weight-average molecular weight is between 30,000 and 6,000,000 inclusive, the elastomer being at least one thermosetting elastomer selected from the group consisting of natural rubber, urethane rubber, silicone rubber, and fluoro rubber, the metal rolling oil composition contains 0.1 parts by mass or more and 10 parts by mass or less of the surfactant and 0.05 parts by mass or more and 20 parts by mass or less of the elastomer, for 100 parts by mass of the base oil.

2. The coolant which is prepared by dispersing, in water, the metal rolling oil composition according to claim 1, wherein the metal rolling oil composition further comprises an oiliness agent.

3. The coolant which is prepared by dispersing, in water, the metal rolling oil composition according to claim 1, wherein the metal rolling oil composition further comprises an antioxidant.

4. The coolant according to claim 1, wherein the surfactant is at least one selected from the group consisting of: alkane sulfonate sodium salt; sodium naphthenate soap; alkylbenzene sulfonate sodium salt; alkyltrimethylammonium salt; dialkyl dimethyl ammonium chloride; alkylpyridinium chloride; a propyleneglycol-ethyleneglycol copolymer; and a monoester or polyester prepared from at least one of a higher fatty acid, poly-fatty acid, and polycondensed hydroxy fatty acid, and at least one polyhydric alcohol selected from polyethyleneglycol, glycerin, and sorbitol.

5. The coolant according to claim 2, wherein the surfactant is at least one selected from the group consisting of: alkane sulfonate sodium salt; sodium naphthenate soap; alkylbenzene sulfonate sodium salt; alkyltrimethylammonium salt; dialkyl dimethyl ammonium chloride; alkylpyridinium chloride; a propyleneglycol-ethyleneglycol copolymer; and a monoester or polyester prepared from at least one of a higher fatty acid, poly-fatty acid, and polycondensed hydroxy fatty acid, and at least one polyhydric alcohol selected from polyethyleneglycol, glycerin, and sorbitol.

6. The coolant according to claim 3, wherein the surfactant is at least one selected from the group consisting of: alkane sulfonate sodium salt; sodium naphthenate soap; alkylbenzene sulfonate sodium salt; alkyltrimethylammonium salt; dialkyl dimethyl ammonium chloride; alkylpyridinium chloride; a propyleneglycol-ethyleneglycol copolymer; and a monoester or polyester prepared from at least one of a higher fatty acid, poly-fatty acid, and polycondensed hydroxy fatty acid, and at least one polyhydric alcohol selected from polyethyleneglycol, glycerin, and sorbitol.

7. The coolant according to claim 1, wherein the average particle size of the oil component in the coolant is between 5 μm and 9 μm inclusive.

8. The coolant according to claim 2, wherein the average particle size of the oil component in the coolant is between 5 μm and 9 μm inclusive.

9. The coolant according to claim 3, wherein the average particle size of the oil component in the coolant is between 5 μm and 9 μm inclusive.

* * * * *